US005281775A

United States Patent [19]

Gremillion

[11] Patent Number: 5,281,775

[45] Date of Patent: Jan. 25, 1994

[54] VIBRATING HOLE FORMING DEVICE FOR SEISMIC EXPLORATION

[75] Inventor: Ernest J. Gremillion, P.O. Box 556, Larose, La. 70373

[73] Assignees: Richard A. Gremillion, Cut Off; Ernie J. Gremillion; Steven M. Gremillion, both of Larose; Hazel T. Gremillion, Cut Off, all of La. ; part interest to each

[21] Appl. No.: 961,851

[22] Filed: Oct. 16, 1992

[51] Int. Cl.[5] ..... G01V 1/06

[52] U.S. Cl. ..... 181/116; 102/313; 175/19; 175/22; 173/49

[58] Field of Search ..... 175/19, 55, 189, 2, 175/22; 74/61; 173/49; 181/116; 102/313

[56] References Cited

U.S. PATENT DOCUMENTS

| | | | |
|---|---|---|---|
| 3,106,258 | 10/1963 | Muller | 175/19 |
| 3,242,999 | 3/1966 | Garner | 175/19 |
| 3,394,766 | 7/1968 | Lebelle | 173/49 |
| 3,752,242 | 8/1973 | Gremillion | 175/108 |
| 3,920,083 | 11/1975 | Makita | 173/49 |
| 3,939,771 | 2/1976 | McReynolds | 102/313 |
| 4,471,669 | 9/1984 | Seaberg | 74/687 |
| 4,553,443 | 11/1985 | Rossfelder et al. | 175/55 |
| 4,819,740 | 4/1989 | Warrington | 173/49 |

*Primary Examiner*—J. Woodrow Eldred

*Attorney, Agent, or Firm*—Jacobson, Price, Holman & Stern

[57] ABSTRACT

A vibrating hole forming device for seismic exploration in which a vertically elongated mounting pipe with attached rack gear is powered vertically by a hydraulically driven pinion gear which will mechanically push the pipe downwardly into the earth's surface. A vibrating mechanism imparts vibration to the downward force exerted by the pinion gear and rack gear. Vibration is imparted to the pipe automatically when hydraulic pressure required to operate the pinion gear reaches a predetermined pressure such as when the point on the lower end of the pipe encounters a predetermined resistance to further downward movement. This enables a lightweight unit to impart a constant downward force and a vibration force when needed to enable the device to penetrate through sands or extremely dense subsurface terrain thereby eliminating the necessity of providing a heavy weight vehicle such as is required when conventional hole forming devices are used on which the device is mounted.

15 Claims, 5 Drawing Sheets

VIBRATING HOLE FORMING DEVICE FOR SEISMIC EXPLORATION

BACKGROUND OF THE INVENTION

1. Field of the Invention

The present invention generally relates to seismic exploration and more particularly to vibrating hole forming device in which a vertically elongated mounting pipe with attached rack gear is powered vertically by a hydraulically driven pinion earth's surface. A vibrating mechanism imparts vibration to the downward force exerted by the pinion gear and rack gear. Vibration is imparted to the pipe automatically when hydraulic pressure required to operate the pinion gear reaches a predetermined pressure such as when the point on the lower end of the pipe encounters a predetermined resistance to further downward movement. This enables a lightweight unit to impart a constant downward force and a vibration force when needed to enable the device to penetrate through sands or extremely dense subsurface terrain thereby eliminating the necessity of providing a heavy weight vehicle such as is required when conventional hole forming devices are employed.

2. Description of the Prior Art

As is well known, seismic exploration of underground formations is conducted by positioning a plurality of explosive seismic charges below ground level at a designated depth and in designated pattern with these charges being subsequently detonated to produce seismograph recordings which can be analyzed to determine the character of the underground formation including whether the underground strata includes potentially recoverable oil or gas deposits and the like. Various devices have been provided to form vertical bores or holes in the earth's surface in which seismic charges are placed. Seismic exploration is necessarily conducted in locations having difficult access and terrain characteristics which are difficult to traverse. Various types of vehicles are utilized to convey seismic exploration equipment to an exploration site. Such vehicles are necessarily relatively heavy in order to provide a downward force on drilling or other earth penetrating equipment used to form vertical holes or bores in the earth to receive the explosive seismic charges. The necessity of making such vehicles heavy also introduces additional problems of gaining access to an exploration site. The following U.S. Pat. relate to this field of endeavor and include vibrating devices to assist in forming bore holes.

U.S. Pat. No. 3,394,766
U.S. Pat. No. 3,920,083
U.S. Pat. No. 4,471,669
U.S. Pat. No. 4,553,443
U.S. Pat. No. 4,819,740

While the above patents disclose vertically elongated members having vibration characteristics imparted thereto, none of the above patents disclose a vibrating mechanism associated with an elongated vertical pipe and rack gear attached thereto combined with a driven pinion gear which will force the pipe, which has a point on the lower end, into the earth and automatically impart vertical vibration to the pipe, rack gear and point when a predetermined resistance to downward penetration of the underground formation is encountered.

SUMMARY OF THE INVENTION

An object of the present invention is to provide a device capable of forming a vertical hole or bore for inserting a seismic charge below ground level to a designated depth to facilitate production of seismograph recordings which includes an elongated vertically disposed pipe that is supported and guided for vertical reciprocation with the pipe having an elongated rack gear mounted thereon in meshing engagement with a hydraulically driven pinion gear by which the pipe with a point on the lower end can be pushed downwardly into the earth to a predetermined desired depth.

Another object of the invention is to provide a vibrating hole forming device in accordance with the preceding object in which a vibrating mechanism including a framework with a vibrator mounted thereon is operatively connected with the pinion gear to automatically vibrate the rack gear, pipe and point on the lower end vertically when a predetermined resistance to earth penetration is encountered by the point on the lower end of the pipe thus utilizing a downward force and a vibrating force in the form of an up and down motion when the resistance found in subsurface formations is greater than the weight and force capabilities of the device with this combination of downward force and vibration force delivering a dual force which can be produced by a lightweight unit which will penetrate through sands or extremely dense subsurface terrain with relative ease thereby eliminating the necessity of an excessive weight factor being incorporated into the vehicle o vessel on which the device is mounted.

Still another object of the invention is to provide a vibrating hole forming device for seismic exploration as set forth in the preceding objects in which the supporting and guide structure as well as the operating structures cooperate to efficiently position a plurality of explosive seismic charges in a desired pattern and at a desired depth with the device being relatively inexpensive to construct, longlasting and dependable, efficient and capable of being mounted on lightweight vehicles or vessels to facilitate transport to an exploration site as compared with a relatively heavy vehicle which would be necessary to provide a reaction force if the vibrating mechanism of the present invention was not used.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
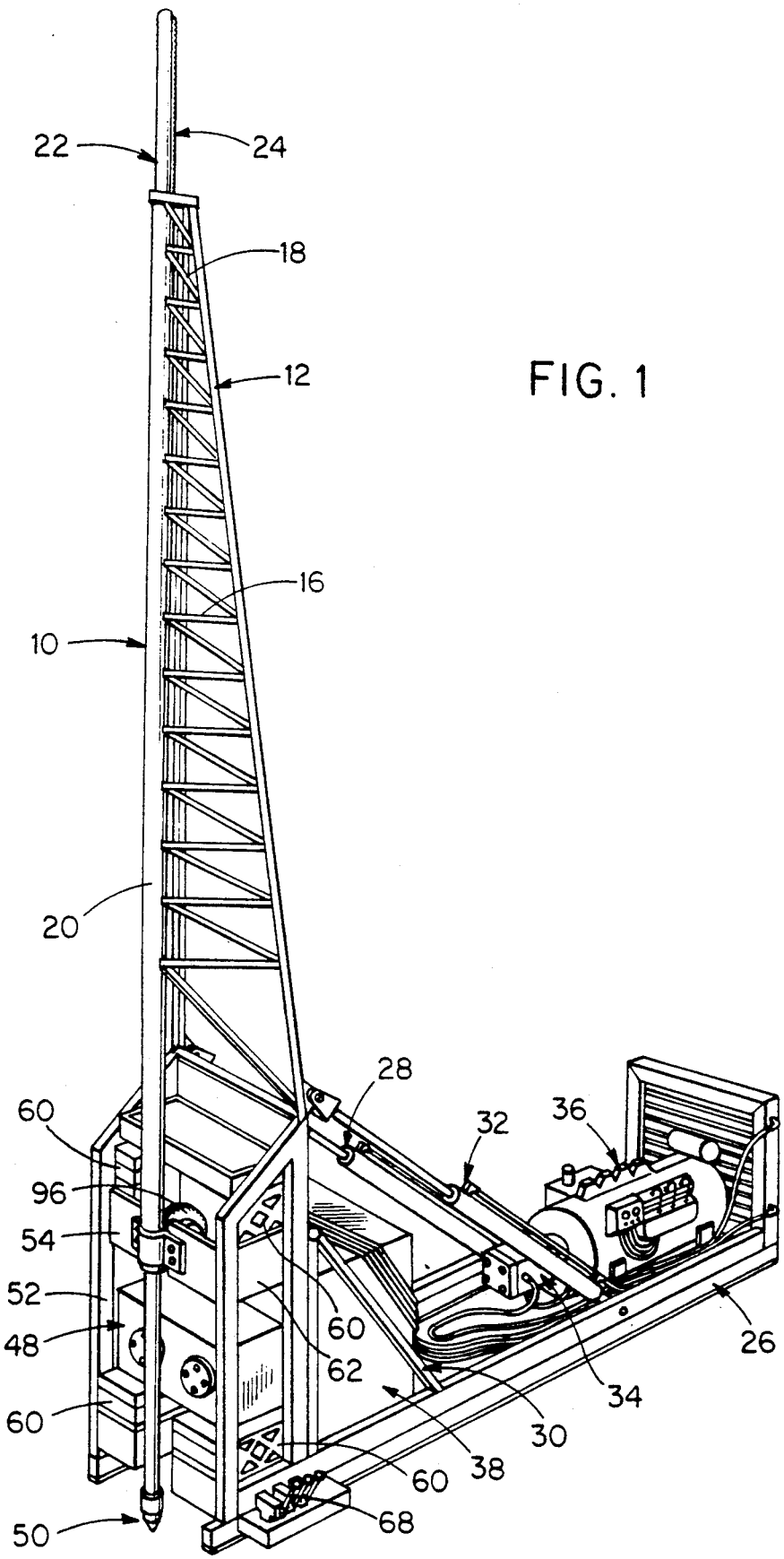
FIG. 1 is a perspective view of the vibrating hole forming device for seismic exploration illustrating the overall structural details of the invention.

Referring to the drawings, the vibrating hole forming device incorporating the present invention therein is generally designated by reference numeral 10 and includes a vertical tower or framework 12 which tapers upwardly and includes vertical members 14, horizontal brace members 16 and diagonal brace members 18. The structure and configuration of the tower can vary but usually it is of triangular cross-sectional configuration with one of the vertical members 18 being in the form of an elongated rigid generally semicylindrical guide tube o sleeve 20 which guidingly supports an elongated mounting pipe 22 therein with the mounting pipe 22 mounting and supporting an elongated, continuous rack gear 24 which extends substantially throughout the length of the mounting pipe 22 and faces away from guide tube 20.

The tower 12 is preferably mounted on a supporting frame or skid 26 which may be positioned on a vessel or may be incorporated rated into various types of land vehicles. The lower end of the tower may be pivotally supported by a horizontally disposed, transversely extending pivot arrangement 28 supported by bracing 30 connected to the frame 26 with hydraulic piston and cylinder assemblies 32 pivoting the tower 18 and related structure to a horizontal position while the device 10 is being transported to a use site and to a vertical position when set up for use. Supported on the frame is a hydraulic pump unit 34, prime mover or motor 36 for driving the same combined with a tank 38 to store and supply hydraulic fluid and a control valve assembly 42 by which the device may be operated.

The control valve assembly 42 includes a control for pivoting the tower 12 between horizontal and vertical positions and provides pressurized hydraulic fluid to a hydraulic motor 44 which drives a pinion gear 46 in meshing engagement with the rack gear 24. The control valve assembly 42 also supplies hydraulic fluid to a hydraulically driven vibratory exciter 48 which operates to impart vertical vibratory movement and forces to the mounting pipe 22 through the pinion gear 46 and rack gear 24. The mounting pipe 22 includes a disposable point generally designated by reference numeral 50 on the lower end thereof. When downward movement of the pipe 22 and point 50 encounters a resistance to penetration of a subsurface formation which cannot be overcome by the weight of the device, vibratory movement and forces will be automatically imparted to the pipe 22 and point 50 mounted thereon to introduce an additional downward vibratory force without requiring a heavy counteracting weight to move the mounting pipe and point downwardly in the subsurface formation to a desired depth.

Figure 2:
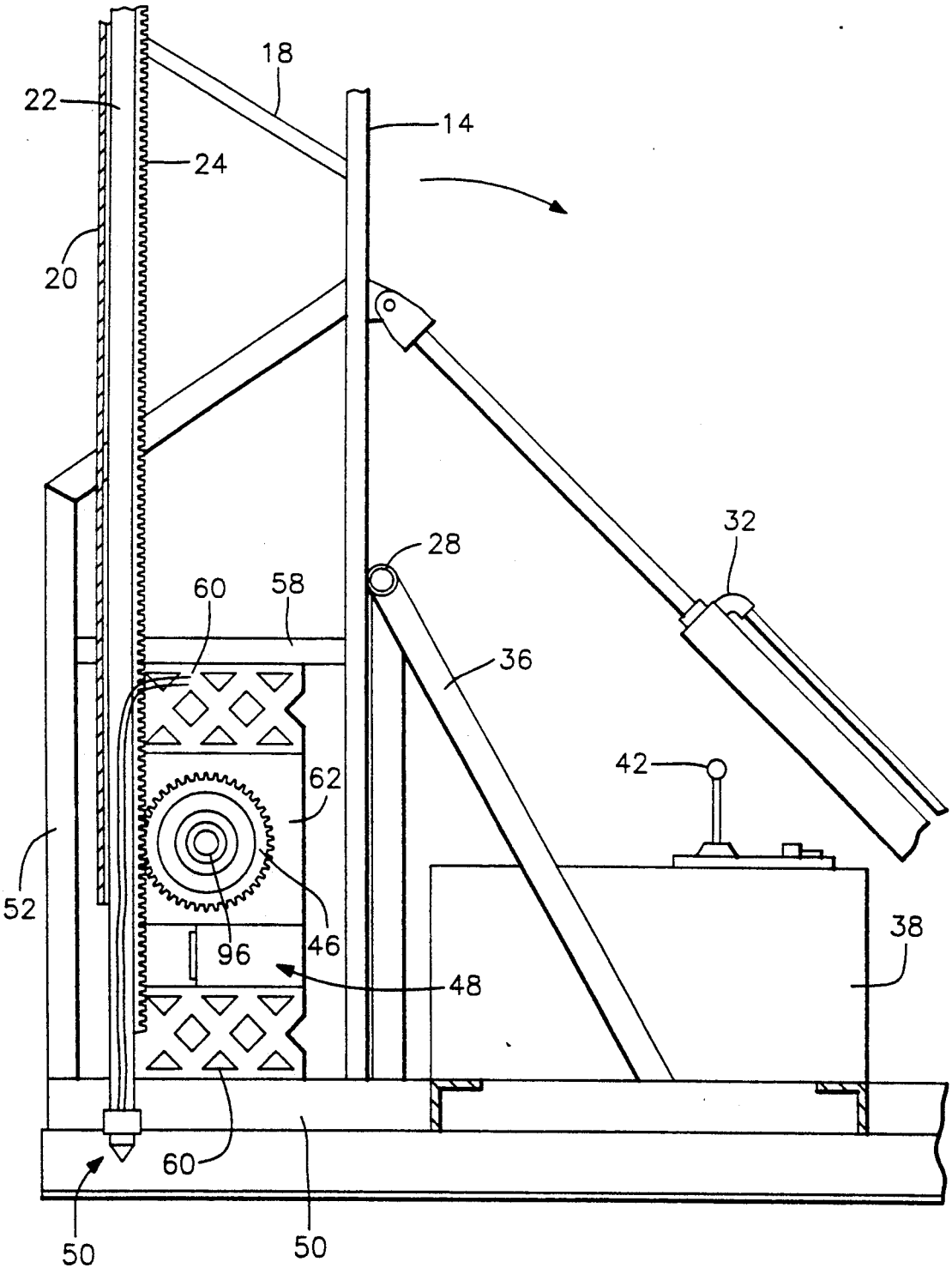
FIG. 2 is a fragmental vertical sectional view, on an enlarged scale, of the operative components of the device of the present invention.
Figure 3:
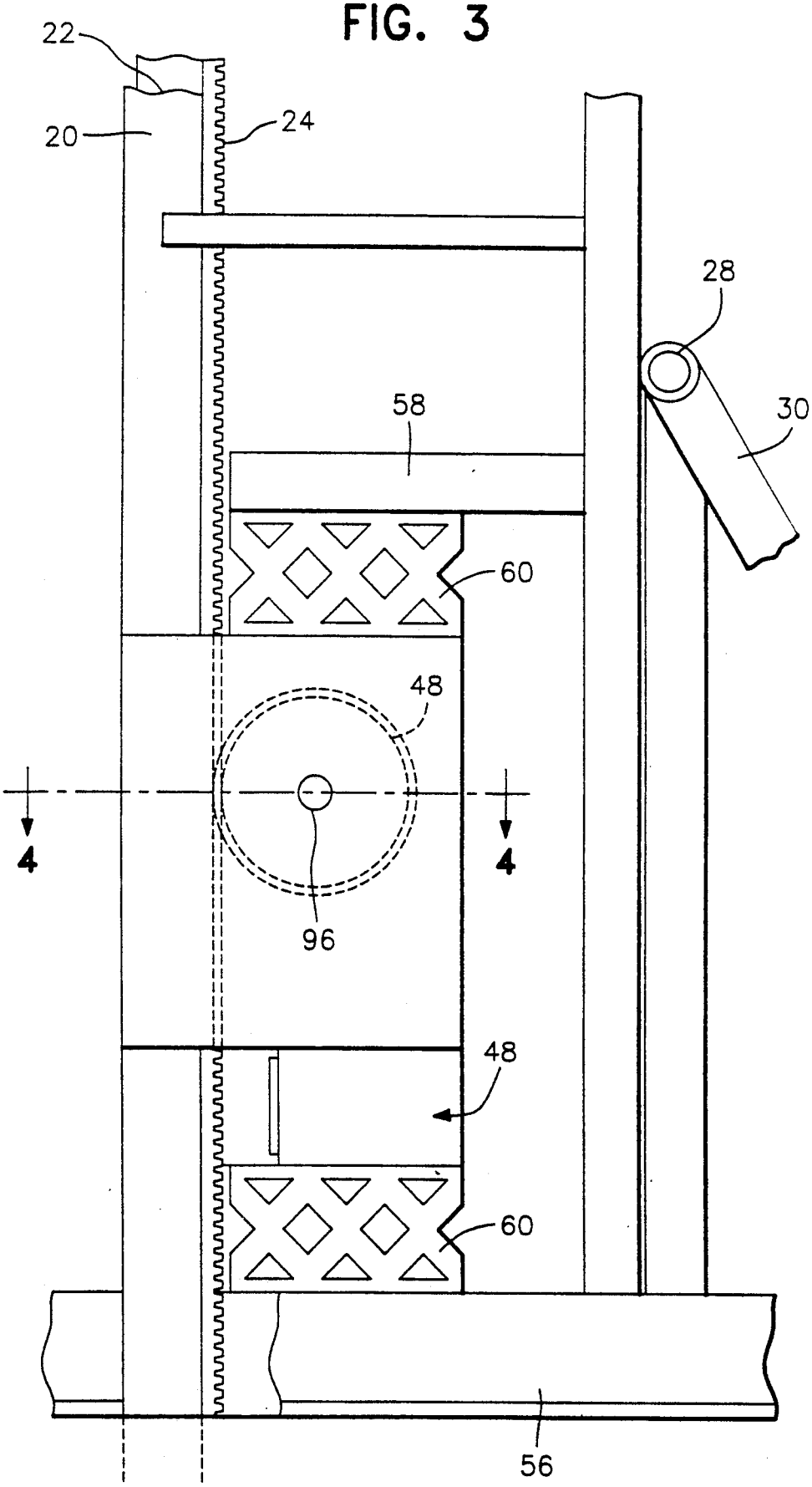
FIG. 3 is a detailed vertical sectional view, on an enlarged scale, illustrating structural details of the hydraulic drive mechanism exerting downward force on the vertically movable pipe.
Figure 4:
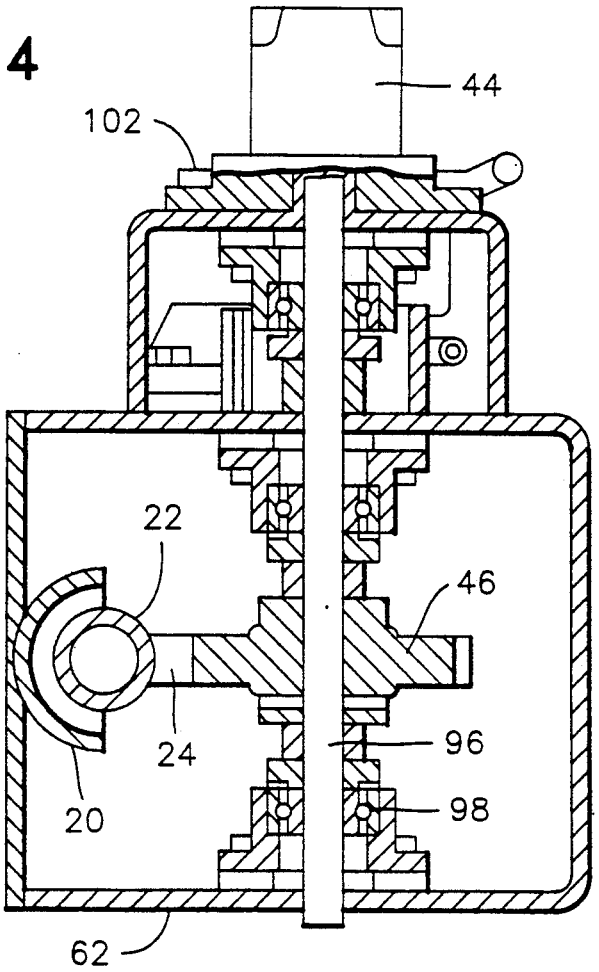
FIG. 4 is a transverse, plan sectional view taken along section line 4—4 on FIG. 3 illustrating further structural details of the hydraulic drive.

The lower end of the tower 12 includes a vertically disposed supporting frame 52 which includes a bracket structure 54 supporting the lower end of the guide tube 20 with the bracket structure 54 being adjustable to compensate for wear between the guide tube 20 and the pipe 22. Positioned between a bottom frame member 56 and a top frame member 58 of the frame 52 is a pair of rubber latticework supports 60 which supports a housing structure 62 supporting the pinion gear 46 and hydraulic motor assembly 44 and the vibratory exciter 48 as illustrated in FIGS. 2 and 3. The vibratory exciter 48 includes a housing 64 with a pair of rotating eccentrically weighted members 66 therein which may be similar to the structure disclosed in U.S. Pat. No. 4,819,740 issued Apr. 11, 1989 or U.S. Pat. No. 4,553,443 issued Nov. 19, 1985. The housing 64 of the vibratory exciter is rigidly affixed to the housing 62 for rack gear 46 such as by welding or the like and both of these units are supported by the lattice rubber machinery mounts or supports 60 from the frame members 56 and 58. Four machinery mounts or supports 60 are provided as illustrated in FIG. 1 to reduce the amount of vibration transferred to the frame 52 and isolate the vibration to the area and equipment between the rubber lattice machine mounts or supports 60. The frequency and amplitude of the vibratory exciter may be varied such as by varying the amount of weight in the form of lobes on each eccentric rotable weight 66 in the vibratory exciter and the frequency can be varied by also varying the eccentric weight orientation on the eccentric weights 66 rather than by using a variable speed motor.

Figure 5:
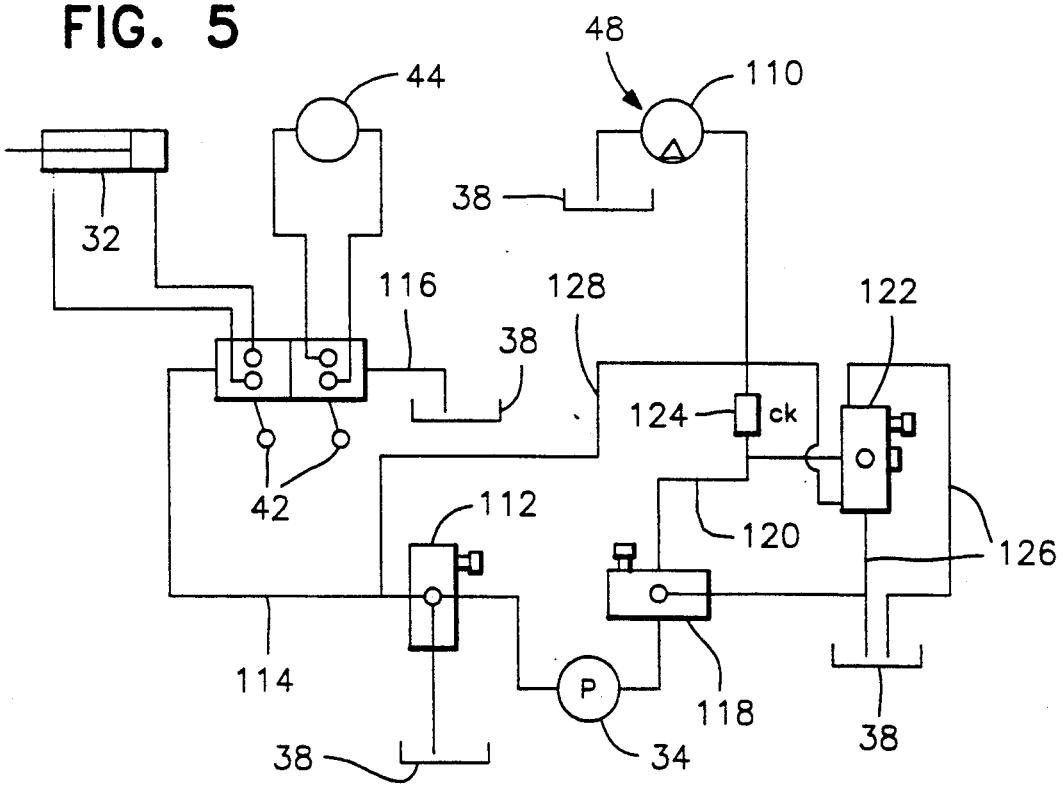
FIG. 5 is a schematic flow diagram illustrating the hydraulic drive mechanism and the structure which automatically actuates the vibrating mechanism when a predetermined resistance to penetration of an underground formation by the point on the mounting pipe is encountered.
Figure 6:
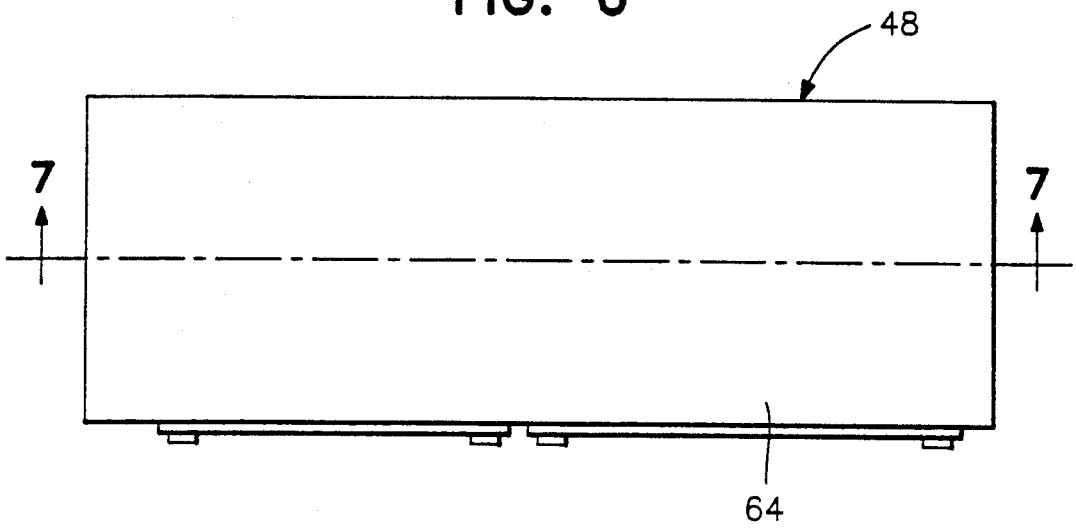
FIG. 6 is a plan view of the vibratory exciter used in this invention.
Figure 7:
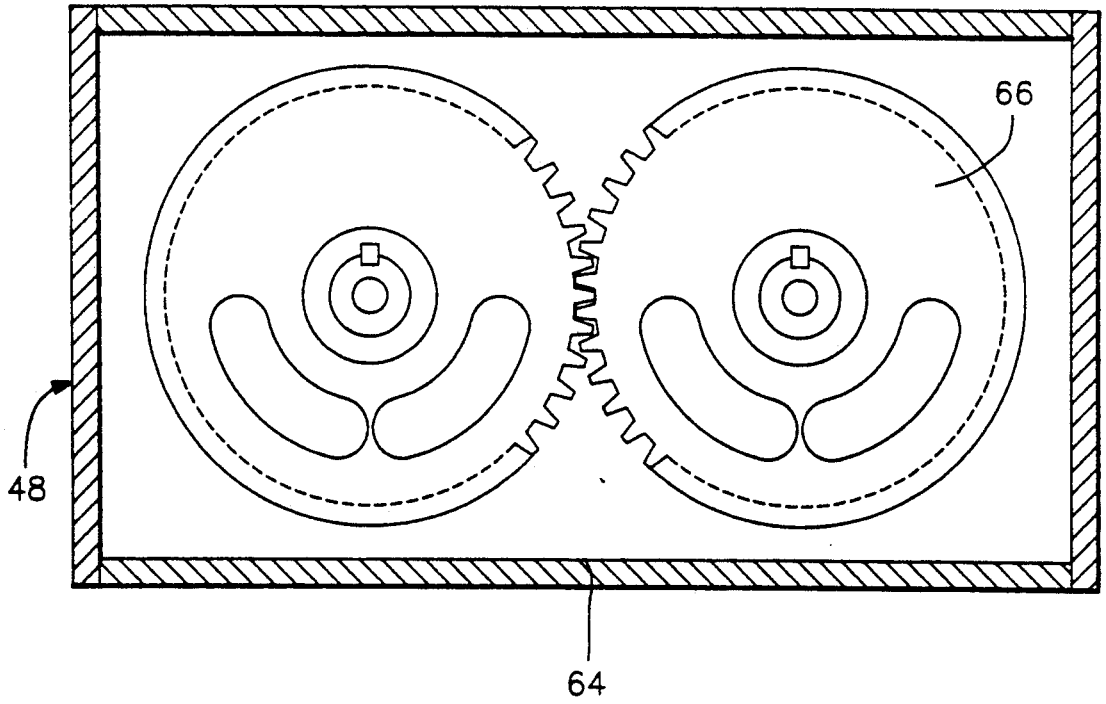
FIG. 7 is a vertical sectional view of the vibratory exciter taken generally along section line 7—7 on FIG. 6.

The vibratory exciter is driven by a hydraulic motor with suitable controls 68 similar to the hydraulic motor 44 for driving the pinion gear 46 that is supported by a shaft 96 supported by bearings 98 in the housing 62 with the motor being provided with a bracket 102 all of which cooperate to impart rotation to the pinion gear 46 to move the pipe 22 vertically with the vibratory exciter being actuated automatically by the vibratory hydraulic motor 110, illustrated schematically in FIG. 5, which is energized when downward resistance encountered by the point 50 and pipe 22 exceeds a predetermined resistance.

This occurs as a result of the hydraulic system illustrated in FIG. 5 in which the pump 34 and motor 36 are schematically illustrated with the pump 34 being communicated with the tank schematically illustrated at 38. The pump discharges pressurized fluid through a relief valve 112 to manual control valve assemblies 42 for actuating the motor 44 for the pinion gear 46 and the lay down piston and cylinder assemblies 32 for the tower with pressure line 114 interconnecting the relief valve 112 and the control valve assemblies 42 and a drain line 116 returning fluid back to the tank 38. The pump 34 also supplies pressurized fluid to a relief valve 118 supplying pressurized fluid through pressure line 120 to a pressure reducing relief valve 122 and a check valve 124 with the relief valves 118 and 122 including drain lines 126 back to the tank 38. The valve 122 includes a pilot line 128 communicated with pressure line 114 which conveys the pressure in line 114 into valve 122 for control thereof. When the motor 44 encounters a predetermined resistance to rotation due to the point 50 encountering resistance to penetration of the subsurface formation of a certain magnitude, the pressure in line 114 will increase and cause valve 122 to supply fluid past the check valve to the hydraulic motor 110 for the vibratory exciter 48 with the motor 110 including a drain line 130 back to the tank 35. As long as the point 50 and the mounting pipe 22 meet normal resistance or a resistance which does not exceed the downward force that can be created by the weight of the supporting frame and vehicle, the vibratory exciter motor will not be energized. However, when the pressure in line 114 builds up due to resistance to further downward movement which approaches or exceeds the weight of the vehicle and the force that can be exerted by the pinion gear 46, the pilot line 128 will actuate the valve 122 to supply pressurized fluid to the vibratory motor 110 thus introducing a vibrating movement and force to the mounting pipe 22 and point 50 in order to enable the resistance to penetration to be overcome by using the dual force that is exerted by the drive pinion and weight of the unit and the vehicle on which it is mounted and the vibrating force which is automatically actuated when the resistance to penetration reaches a predetermined resistance. The check valve 124 and the pressure relief valve 122 provide a bypass of the fluid through the valve 122 back into the drain line 126. When pressure in the pilot line 128 increases, the valve 122 will then cause pressurized fluid to overcome the check valve 124 and communicate pressure line 120 with the hydraulic motor 110 for the vibratory exciter 48.

The location of the vibratory exciter 48 may vary as long as equal vibratory forces are exerted symmetrically on the housing 62 to move the shaft 96 and pinion gear 46 vertically while maintaining meshing contact between the pinion gear 46 and the rack gear 24. Also, the hydraulic motor driving the shaft 96 for the pinion gear 46 may be provided with a suitable reduction gear to move the mounting or planting pipe 22 at a desired relatively slow speed. The downward force that could normally be applied to the pipe 22 would be the weight of the unit and vehicle to which it is attached and any downward force which exceeded this weight would lift the unit and vehicle. Thus, if only the rack and pinion drive unit were used, a relatively heavy vehicle would be required in order to provide adequate downward force to the structure which formed the hole in the earth. By combining the automatic vibration feature, a dual force is exerted including the vibration movement which enables a downward force to be obtained which is greater than the weight of the unit and vehicle. The forces produced by the vibratory exciter 48 cause the housing 62 to vibrate vertically and this force is transferred to the pinion gear 46 and shaft which are supported from the housing 62 thereby transferring impulses from the vibratory exciter 48 to the pinion gear 46 which then transmits the same to the rack gear 24 welded to the pipe 22 thereby producing a downward force by a lightweight unit that has extraordinary penetrating capabilities. The vibratory exciter 48 is automatically actuated when the point on the pipe comes into contact with a dense subsurface formation and encounters a resistance that cannot be penetrated by the downward force provided by the weight of the unit and vehicle. However, the addition of the vibratory exciter and the forces produced thereby will enable penetration without requiring a heavy unit or vehicle with the vibration forces automatically ceasing when the dense subsurface formation has been penetrated. Thus, the vibratory force generated by the present invention is only used when downward force produced by the unit is overcome or exceeded by the resistance encountered in dense subsurface formations.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A vibrating hole forming device for seismic exploration to form a hole downwardly into the surface of the earth for placing an explosive seismic charge in the bottom of said hole, said device comprising a frame, an elongated vertically oriented guide supported on said frame, an elongated vertically mounted pipe member reciprocally supported and guided by said guide and having a point at the lower end thereof; said pipe member including a longitudinally extending, continuous rack gear rigidly connected thereto, a pinion gear rotatably supported on the frame in meshing engagement with the rack gear for moving the rack gear and pipe member vertically, a drive motor connected to said pinion gear for selectively driving the pinion gear to move the pipe member and rack gear upwardly and downwardly, and means supplying vibration forces to said pipe member, said means applying vibrating forces to said pipe member including said pinion gear and drive motor being mounted on a framework, means mounting said framework on said frame for resilient vertical guided movement and vibration producing means mounted on said framework to move the framework and pinion gear in a vertically reciprocating manner for imparting vertical vibration to the rack gear, pipe member and point at the lower end of the pipe member for penetrating dense subsurface formations which resist penetration by exerting a constant downward force on the pipe member while the pipe member is being vertically vibrated said vibration producing means including a vibratory exciter driven by hydraulic pressure and means automatically initiating operation of the vibrator exciter when the resistance to penetration to penetration of a subsurface formation which is greater than the weight of the device and an associated vehicle thereby enabling a hole to be formed by the use of lightweight vehicles and equipment which are capable of traversing uneven terrain with greater efficiency than heavy vehicles.

2. The device as defined in claim 1 wherein said framework and frame include coacting guide means and resilient means enabling vertical vibration of the framework and pipe member.

3. The method of forming a hole in the surface of the earth consisting of the steps of positioning a vertically elongated member at a site where a hole is desired, applying a substantially constant downward force on said member to move it downwardly into the earth when encountering expected resistance to downward movement thereof, and applying vertical vibratory force to said member only when said member encounters a predetermined greater than expected resistance to downward movement into the earth whereby both the substantially constant downward force and the vertical vibratory force combine to move said member downwardly through the encountered greater than expected predetermined resistance.

4. The method as defined in claim 3 together with the steps of releasably mounting a pointed lower end on the vertical member and disconnecting the pointed lower end from the elongated member when the elongated member is retracted thereby leaving the pointed lower end in the bottom of a formed hole in the earth.

5. The method as defined in claim 4 together with the step of mounting an explosive charge on said pointed lower end to remain at the bottom of the formed hole for detonation for use in seismic exploration.

6. The method as defined in claim 5 together with the step of anchoring the pointed lower end in the bottom of the formed hole when retracting the elongated member.

7. The method as defined in claim 3 wherein the step of applying constant downward force on the elongated member includes utilizing a hydraulic motor driving a pinion gear meshed with an elongated rack gear mounted on said elongated member.

8. The method as defined in claim 7 wherein the step of applying vertical vibratory force to the elongated member includes the step of applying a vertical vibratory force to the pinion gear with the pinion gear also transferring the vertical vibratory force to the rack gear and elongated member.

9. The method as defined in claim 8 wherein said step of applying vertical vibratory force includes the step of driving a vibrating device by a hydraulic motor communicated with a source of pressurized fluid in response to pressure buildup in a pressure supply line communicated with the hydraulic motor driving the pinion gear.

10. A vibrating hole forming a device comprising a frame supporting an elongated guide, an elongated rigid, hole forming member reciprocally supported and guided by said guide, said elongated member including a longitudinally extending, continuous rack gear rigidly connected thereto, a pinion gear rotatably supported on the frame in meshing engagement with the rack gear for moving the rack gear and elongated member longitudinally, means connected to said pinion gear for selectively driving the pinion gear to move the elongated member and rack gear longitudinally, and means applying vibrating forces to said elongated member in a longitudinal direction through the meshed pinon gear and rack gear when the elongated member encounters a predetermined unexpected resistance when forming a hole.

11. The device as defined in claim 10 wherein said means driving said pinion gear includes a hydraulic motor to move said elongated member with a generally constant speed and force.

12. The device as defined in claim 11 wherein said pinion gear and motor are mounted on a support mounted on said frame for resilient guided movement in the same direction of movement as the elongated member, said means applying vibrating forces includes vibration producing means mounted on said support to move it in a reciprocating manner for imparting vibration to the pinion gear, rack gear and elongated member, said elongated member including a point at the end thereof for penetrating areas which resist penetration by exerting a constant force on the elongated member while vibrating same.

13. The hole forming device as defined in claim 10 wherein said pinion gear and means driving the pinion gear are mounted on a framework and means resiliently supporting said framework from said frame to enable limited resilient movement of the framework in the longitudinal direction of movement of said elongated member for isolating vibration forces from said frames.

14. The hole forming device as defined in claim 13 wherein said means supporting the framework from said frame includes a block of latticed resilient material supportingly engaging opposite areas of said framework, said frame including spaced support areas in supporting engagement with said blocks in opposed relation to said framework.

15. The hole forming member as defined in claim 10 wherein said means applying vibratory forces includes a motor driving said pinion gear, and a motor driven vibrating device connected with a support for said pinion gear and means sensing the force exerted by said motor when driving the pinion gear and actuating said vibrating device wherein the force exerted by said motor exceeds a force necessary to move said elongated member in a longitudinal direction when the elongated member encounters an expected resistance.

* * * * *